United States Patent [19]

King, III

[11] Patent Number: 4,934,853

[45] Date of Patent: Jun. 19, 1990

[54] TYPEWRITER COPY HOLDER APPARATUS

[76] Inventor: Robert R. King, III, 8050 Florida Blvd., Baton Rouge, La. 70806

[21] Appl. No.: 290,646

[22] Filed: Dec. 27, 1988

[51] Int. Cl.[5] ..... B41J 29/00

[52] U.S. Cl. ..... 400/718; 248/442.2; 40/354

[58] Field of Search ..... 400/718, 23, 718.1, 400/718.2, 24–49; 248/442.2; 40/341, 342, 343, 352–357, 547; 74/516, 518

[56] References Cited

U.S. PATENT DOCUMENTS 449,212 3/1846 Solem ..... 248/442.2

469,658 2/1892 Chapman ..... 40/354

FOREIGN PATENT DOCUMENTS 2145038A 3/1985 United Kingdom ..... 400/718

*Primary Examiner*—Edgar S. Burr

*Assistant Examiner*—M. Patel

*Attorney, Agent, or Firm*—Leon Gilden

[57] ABSTRACT

A copy holder apparatus for use in combination with a conventional typewriter is set forth. The apparatus includes a generally "S" shaped transparent bracket with a lower leg defining a slot to accept a typewriter table in a conventional typewriter. The upstanding leg of the apparatus includes a spring clip cooperative with an outer face of leg for securement of documents to be copied. A fiber optic cursor is vertically positionable along the upstanding leg to indicate and accent lines to be copied by an operator. The upstanding leg is angulated at approximately thirty degrees relative to the lower leg to orient the document to be copied relative to an operator.

9 Claims, 4 Drawing Sheets

TYPEWRITER COPY HOLDER APPARATUS

BACKGROUND OF THE INVENTION

1. Field of the Invention

The field of invention relates to copy holders, and more particularly pertains to a new and improved copy holder for a typewriter including a fiber optic positionable cursor for highlighting documents to be copied 2. Description of the Prior Art The prior art has provided the use of copy holders in combination with typewriters in the past wherein the prior art devices have heretofore failed to provide a compact organization utilizing document high-lighting means. In this connection there have been several attempts to develop copy holding devices which may be easily and efficiently associated with existing typewriters. For example, U.S. Pat. No. 1,370,737 to Furrey sets forth a bracket securable to a forward edge framework of a typewriter to support a transparent "L" shaped document support. The Furrey patent sets forth an early example of a document copy support stand, but is of a relatively cumbersome organization, as opposed to the instant invention.

U.S. Pat. No. 1,830,478 to Moseley sets forth a book-holding attachment for use with typewriters including a plurality of transverse brackets mounted to a support plate positionable adjacent an existing typewriter. The Moseley patent, due to its positioning offset to a typewriter, fails to set forth the alignment of the document-&and the typewriter keys, as is desirable.

U.S. Pat No. 1,330,687 to Kobler. et al., sets forth a copy holder for a typewriter wherein an elaborate framework is pivotally mounted to a plurality of upstanding brackets permanently mounted to the typewriter to provide support for a pivotal copy support plate mounted on the apparatus.

U.S. Pat. 3,762,529 to Griffith sets forth a copy holder for dispensing gummed labels from a wound roll onto a typewriter. The pedestal arrangement is mounted for underlying securement to a typewriter to position the dispenser overlying the typewriter paper table.

U.S. Pat. No. 4,243,385 to Singley sets forth an elongate bracket utilizing a plurality of downwardly depending legs for underlying securement to a typewriter wherein the bracket extends upwardly beyond the typewriter to support a document for copying.

As such, it may be appreciated that there is a continuing need for a new and improved typewriter copy holder apparatus which addresses both the problems of compactness and ease of use, and in this respect the present invention substantially fulfills this need.

SUMMARY OF THE INVENTION

In view of the foregoing disadvantages inherent in the known types of typewriter copy holder apparatus now present in the prior art, the present invention provides a typewriter copy holder apparatus wherein the same may be compactly secured in association with an existing typewriter and readily removed and stored during periods of non-use. As such, the general purpose of the present invention, which will be described subsequently in greater detail, is to provide a new and improved typewriter copy holder apparatus which has all the advantages of the prior art copy holder apparatus and none of the disadvantages.

To attain this, the present invention comprises a generally "S" shaped transparent bracket formed of polymeric material for securement to a typewriter table at an uppermost edge thereof. The "S" shaped bracket includes a "U" shaped slot formed by the lowermost leg of a first length for slidingly receiving the typewriter table therewithin with the upstanding leg of the bracket provided with a securement clip at an upper edge thereof for securement of a document depending downwardly therefrom. The upstanding leg is canted at approximately thirty degrees relative to the lower leg to orient the document relative to an operator of the typewriter. A vertically positionable cursor utilizing a fiber optic high-lighting arrangement is secured to the upstanding leg for high-lighting predetermined portions of the document.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved typewriter copy holder apparatus which has all the advantages of the prior art typewriter copy holder apparatus and none of the disadvantages.

It is another object of the present invention to provide a new and improved typewriter copy holder apparatus which may be easily and efficiently manufactured and marketed.

It is a further object of the present invention to provide a new and improved typewriter copy holder apparatus which is of a durable and reliable construction.

An even further object of the present invention is to provide a new and improved typewriter copy holder apparatus which is susceptible of a low cost of manufacture with regard to both materials and labor, and which accordingly is then susceptible of low prices of sale to the consuming public, thereby making such typewriter copy holder apparatus economically available to the buying public.

Still yet another object of the present invention is to provide a new and improved typewriter copy holder apparatus which provides in the apparatuses and methods of the prior art some of the advantages thereof, while simultaneously overcoming some of the disadvantages normally associated therewith.

Still another object of the present invention is to provide a new and improved typewriter copy holder apparatus wherein the same may be readily associated to an existing typewriter utilizing fiber optic high-lighting to enhance visual observation of portions of a document to be copied.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
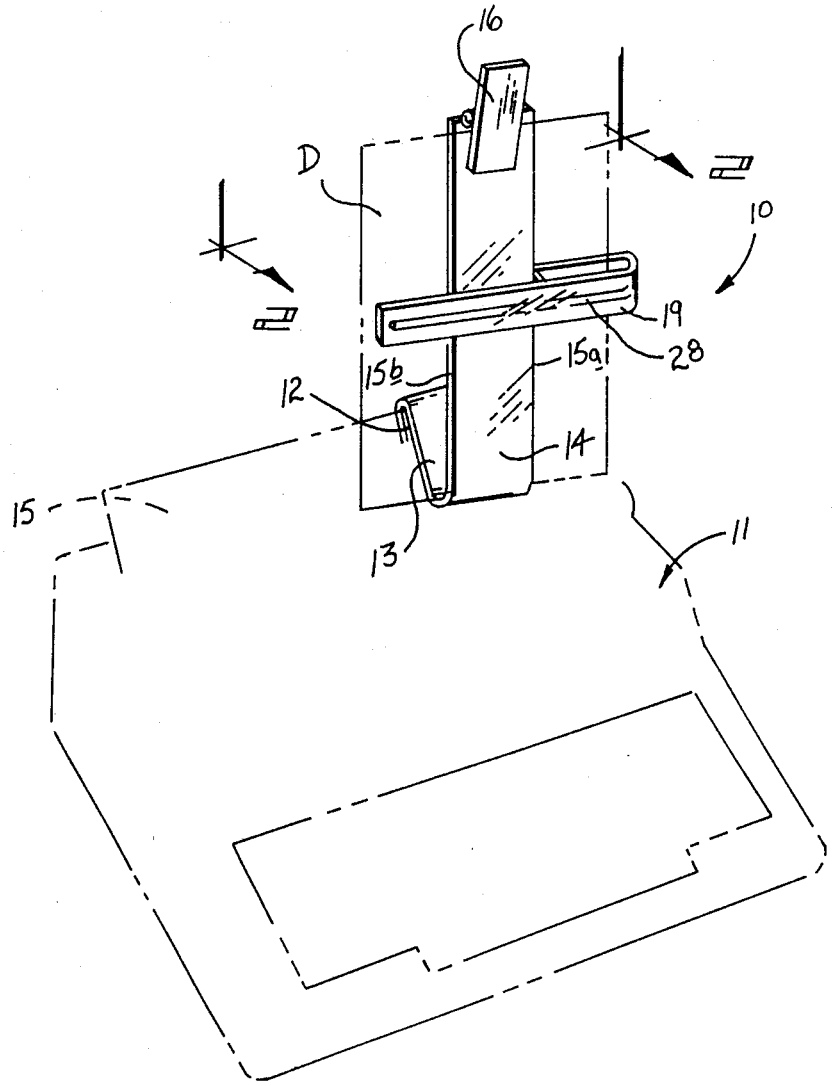
FIG. 1 is an isometric illustration of the instant invention.
Figure 2:
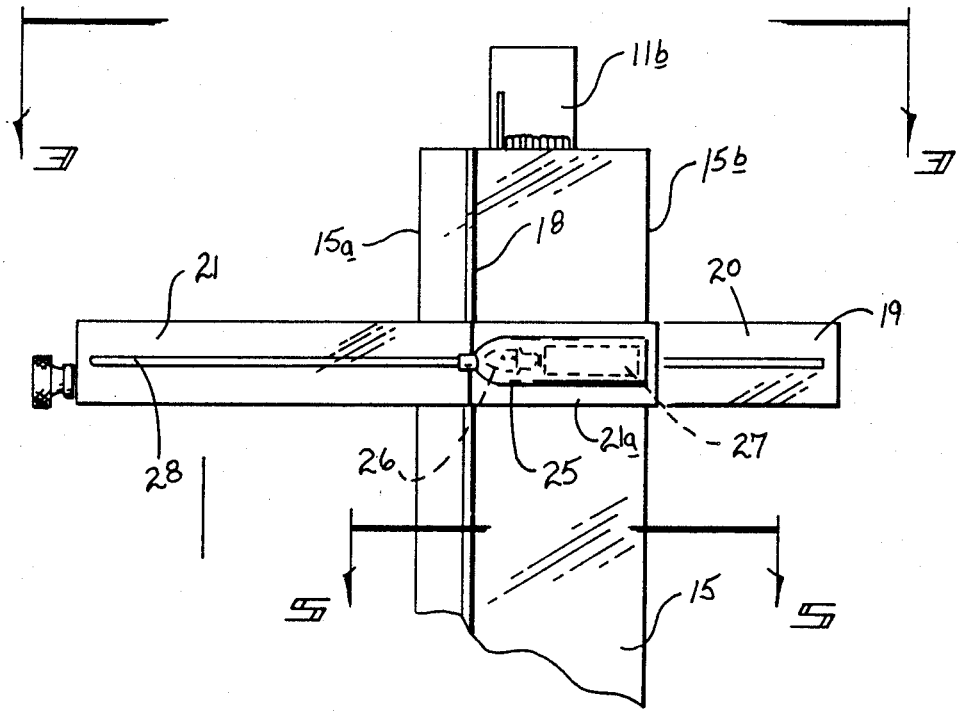
FIG. 2 is an orthographic view taken along the lines 2—2 of FIG. 1 in the direction indicated by the arrows.

With reference now to the drawings, and in particular to FIGS. 1 to 5 thereof, a new and improved typewriter copy holder apparatus embodying the principles and concepts of the present invention and generally designated by the reference numeral !0 will be described.

More specifically, it will be noted that the typewriter copy holder apparatus 10 is releasably secured to a typewriter 11, and more specifically the rearwardly extending typewriter paper table 15. The typewriter copy holder apparatus 10 comprises a firs& lower leg !2 spaced from and parallel to an intermediate second leg of a greater length than the first leg 12 and extending downwardly blending into the third upstanding leg 14. The spacing defined between the first lower leg and the parallel second intermediate leg 13 defines a slot for slidingly receiving the typewriter paper table 15 therewithin and is therefore of a dimension substantially equal to the thickness of a conventional typewriter table 15.

Integrally secured to an upper terminal edge of the third leg 14 is a clip 16 for securement of a document "D" between the clip 16 and the third leg 14. The clip 16 is biased against the outer surface of the third leg 14 by a coil spring 17 integrally secured to the upper terminal edge of the third leg 14.

A rib 18 is co-extensive with and integrally secured to a rear face of the third leg 14 adjacent a right side **15*a* and offset with respect to the left side 15*b* of the third leg 14. The rib 18 enables adjustment of a "U" shaped cursor plate 19 extending orthogonally about the third leg 13 and formed with a forward leg 20 of a length of approximately nine inches to accommodate the width of standard documents. To this end, the length of the third leg 14** is approximately eleven or fourteen inches to accommodate standard or legal length document sheets of paper "D".

The forward leg 20 of the "U" shaped cursor plate 19 is spaced parallel to a rearward leg 21 formed with a recessed lower leg portion **21*a* spaced inwardly towards the forward leg 20 to provide accommodation of a canister 25, whose purpose will be described in more detail below. A connecting web 22 orthogonally formed between the forward leg 20 and rearward leg 21 joins the two legs together. Extending between the forward and rearward legs 20 and 21 respectively is a first "L" shaped leg formed with a forward end overlying the right side 15*a* of the third upstanding leg 14 spaced from a second shorter "L" shaped leg orthogonally and integrally secured to a terminal edge of the recessed lower leg portion 21*a*. The first and second respective "L" shaped legs 23 and 24 are parallel and of a spacing substantially equal to that of the width of the third upstanding leg 14 to orthogonally orient the forward leg 20 and an included fiber optic thread 28 orthogonally relative to the third leg 14 and more particularly to an included document sheet "D" to provide an illuminated cursor for enhanced visual determination of positioning by an operator of the typewriter 11**.

The "S" shaped bracket and the "U" shaped cursor plate are desirably formed of transparent material such that an operator may view through the forward leg 20 of the "U" shaped cursor to view a document sandwiched between the forward leg 20 and the upstanding third leg 14 and secondly, the transparency of the various apparatus parts diminishes the bulky appearance and distraction inherent with opaque apparatus utilized in typewriter copy holder environments.

The fiber optic thread 28 extending through the forward leg 20 is operably associated with the aforenoted canister 25 The canister 25 includes an illumination bulb 26 and a conventional and replaceable direct current battery 27 therewithin for illumination of the fiber optic thread 28.

Figure 3:
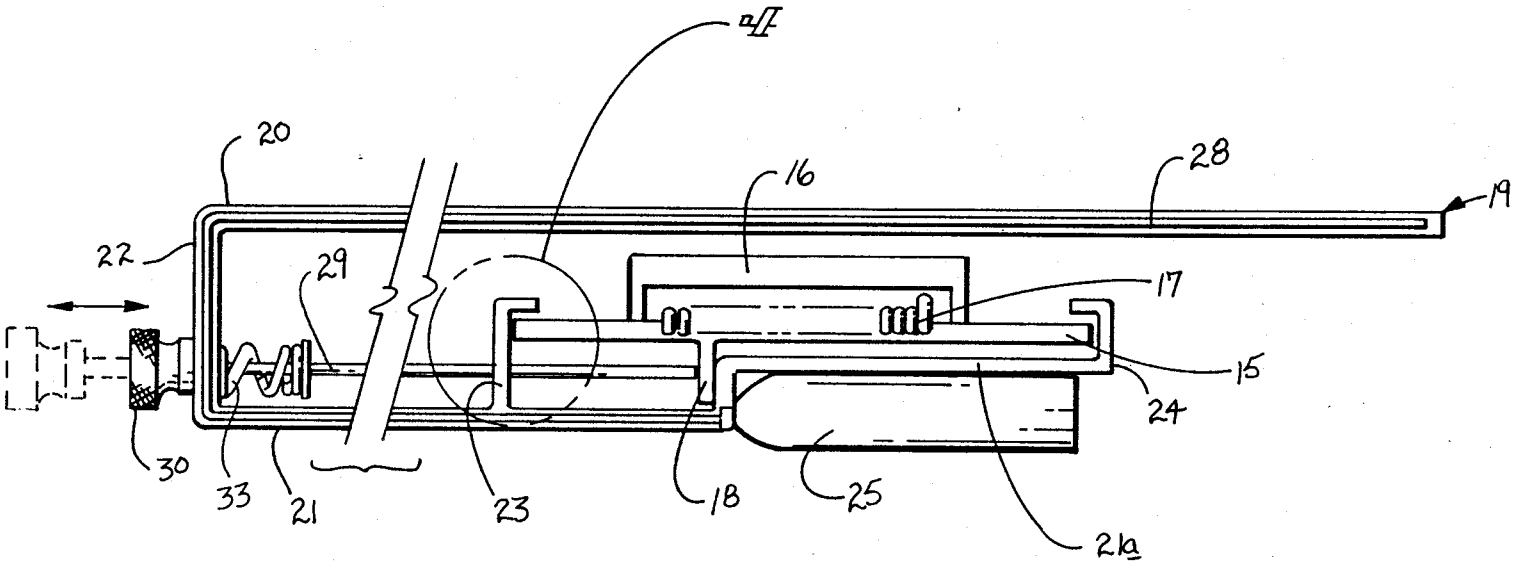
FIG. 3 is an orthographic view taken along the lines 3—3 of FIG. 2 in the direction indicated by the arrows.
Figure 4:
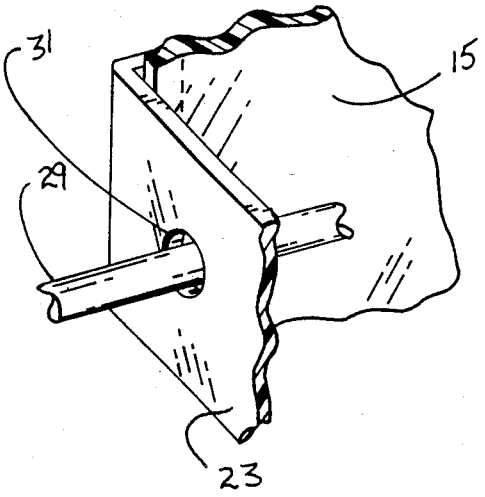
FIG. 4 is an isometric illustration of segment 4 of FIG. 3 somewhat enlarged for enhanced illustration
Figure 5:
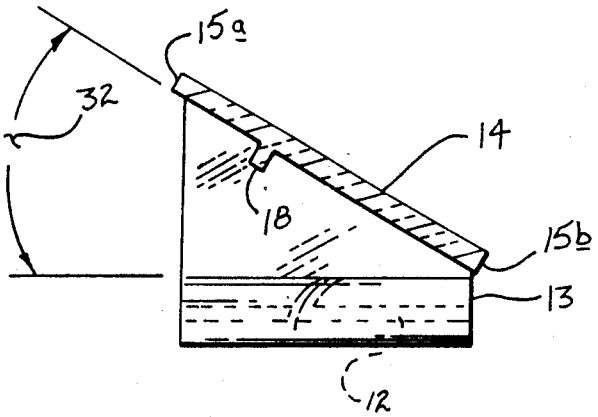
FIG. 5 is a top orthographic diagrammatic illustration of the upstanding leg of the apparatus angularly offset relative to the lower leg.

A securement rod 29 extends through an opening 81 formed through the first "L" shaped leg 28 to frictionally engage the rib 18 integrally formed to the rear surface of the upstanding third leg 14. The securement rod 29 terminates at its other end with a grasping head 80 positioned on one side of the connecting web 22 with a return spring 33 on the other side about the rod 29 to maintain the rod in engagement with the rib 18 until manual withdrawal of the rod 29 by grasping of the head 30, as illustrated in FIG. 3, withdraws the rod for engagement with the rib 18 and enables repositioning of the cursor plate 19 to a further position.

The third leg 14 of the "S" shaped bracket is ideally rotated at a fixed angular relationship to the lower first leg 12 and intermediate second leg 18 at an angle 82 of approximately thirty degrees to skew the third upstanding leg 14 towards the operator of the typewriter 11.

As to the manner of usage and operation of the instant invention, the same should be apparent from the above description and accordingly no further discussion relative to the manner of usage and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly. all suitable modifications and equivalents may be resorted to. falling within the scope of the invention.

What is claimed as being new and desired to be protected by LETTERS PATENT of the United States is as follows:

1. A typewriter copy holder apparatus for use in combination with a typewriter, said typewriter including a paper support table extending rearwardly of said typewriter and of a predetermined thickness, said apparatus comprising.

an "S" shaped bracket including a lower first leg of a first length, an intermediate second leg of a second length, and an upstanding third leg of a third length;

said first lower leg spaced from said second intermediate leg a fixed distance to define a slot to slidingly receive said support table therewithin, and said third upstanding leg including a spring clip fixedly secured proximate an upper free end of said third upstanding leg cooperating with a forward surface of said third upstanding leg to releasably secure a document secured between said clip and said forward surface, and a cursor means selectively positionable along said third upstanding leg and oriented orthogonally thereto for visual enhancement of a predetermined portion of said document, said cursor means including a generally "U" shaped bracket formed with a forward leg, and a rearward leg parallel to said forward leg with a connecting web securing said forward and rearward legs together and wherein said "U" shaped bracket receives said third upstanding leg slidingly between said forward and rearward legs.

2. A typewriter copy holder apparatus as set forth in claim 1 wherein said rearward leg includes a lower leg portion remotely spaced from said connecting web wherein said lower leg portion is spaced inwardly from said rearward leg to define a pocket for receiving a canister therein.

3. A typewriter copy holder apparatus as set forth in claim 2 wherein said "U" shaped bracket includes a fiber optic thread and said canister includes an illumination source for illuminating said fiber optic thread, said fiber optic thread integrally formed within said "U" shaped bracket and extending from said canister along said forward leg and orienting orthogonally relative to said third upstanding leg 4. A typewriter copy holder apparatus as set forth in claim 3 wherein said rearward leg includes a first "L" shaped leg extending between said rearward leg and said forward leg and overlying a first elongate edge of said third upstanding leg, and a second "L" shaped leg extending orthogonally to and integrally connected to said lower leg portion and spaced from said first "L" shaped leg a distance approximately equal to a width defined by said third upstanding leg to align said cursor means relative to said third upstanding leg.

5. A typewriter copy holder apparatus as set forth in claim 4 wherein a friction detent member extends outwardly of said connecting web to position interiorly between said forward and rearward legs and frictionally engages a rib fixedly secured to a rear surface of said third upstanding leg and co-extensive with said third upstanding leg.

6. A typewriter copy holder apparatus as set forth in claim 5 wherein said detent member includes a rod extending through an aperture in said first "L" shaped leg to engage said rib.

7. A typewriter copy holder apparatus as set forth in claim 6 wherein said first lower leg is oriented and arranged parallel to said second intermediate leg to slidingly receive said support table therebetween.

8. A typewriter copy holder apparatus as set forth in claim 7 wherein said "S" shaped bracket and said forward leg of said cursor means are each formed of transparent material.

9. A typewriter copy holder apparatus as set forth in claim 8 wherein said third upstanding leg is rotated thirty degrees relative to said first lower leg and said second intermediate leg to orient the forward surface of said third upstanding leg towards an operator of saId typewriter.

* * * * *